US005579691A

United States Patent [19]

Voge

[11] Patent Number: 5,579,691

[45] Date of Patent: Dec. 3, 1996

[54] SHEET TRANSFER DRUM IN A MULTI-COLOR SHEET-FED ROTARY PRINTING PRESS

[75] Inventor: Michael Voge, Malsch, Germany

[73] Assignee: Heidelberger Druckmaschinen AG, Heidelberg, Germany

[21] Appl. No.: 575,492

[22] Filed: Dec. 20, 1995

[30] Foreign Application Priority Data

Dec. 20, 1994 [DE] Germany ..... 44 45 442.2
Dec. 12, 1995 [DE] Germany ..... 195 46 311.0

[51] Int. Cl.[6] ..... B41F 21/06

[52] U.S. Cl. ..... 101/246; 101/410; 101/420; 101/183; 271/277

[58] Field of Search ..... 101/136, 183, 101/184, 246, 409, 410, 420; 271/275, 276, 277

[56] References Cited

U.S. PATENT DOCUMENTS 3,542,358 11/1970 Schuhmann ..... 101/420
4,735,142 4/1988 Haupenthal .
4,815,379 3/1989 Becker et al. ..... 101/246

FOREIGN PATENT DOCUMENTS 57345 5/1970 Germany .
125394 4/1977 Germany .
3535621 4/1992 Germany .

*Primary Examiner*—Ren Yan
*Attorney, Agent, or Firm*—Herbert L. Lerner; Laurence A. Greenberg

[57] ABSTRACT

A sheet transfer drum of a multi-color sheet-fed rotary printing press. A central drum body with flat portions carries at least one gripper system which extends over the sheet width. Jacket segments are mounted on the flat portions of the drum body. The jacket segments are exchangeably attached and they are formed with an inflatable interior. When they are deflated, the jacket segments fold into the flat portions of the drum body.

16 Claims, 4 Drawing Sheets

9
3
5
12
2
1
13
14
6
7
4
11
8
10

3
6(7)
15
13(14)
12
17
16
18

SHEET TRANSFER DRUM IN A MULTI-COLOR SHEET-FED ROTARY PRINTING PRESS

BACKGROUND OF THE INVENTION

1. Field of the Invention

The invention relates to a sheet transfer drum in a multi-color sheet-fed rotary printing press. The sheet transfer drum is of the type which has a central drum body rotatably mounted about a drum axis in the machine frame and with at least one gripper system extending across the sheet and with jacket segments, which are disposed on a respective flat part of the drum body and which form a sheet-carrying jacket surface which is essentially closed during operation.

2. Description of the Related Art

A sheet transfer drum with those features has become known heretofore from German Patent DD 125 394 (East Germany). That prior art reference describes a sheet transfer drum disposed between two printing units of a multi-color sheet-fed rotary printing press for recto-verso printing. The transfer drum is used in that case as a turning drum, which guides the sheet that has been printed on one side and turned to a following printing unit. There is illustrated an enlarged sheet transfer drum with two gripper systems, which are approximately diametral to the drum axis and which grip a sheet at its leading edge one after the other. The sheet thereby comes to lie against the jacket surface (peripheral surface) of the sheet transfer drum. The contact surface on the jacket of the sheet transfer drum upon which the sheet comes to lie is formed of segment covers, which are detachable and therefore removable or exchangeable for format adaptation. The segment covers each are attachable to a flat part of the drum body between the gripper systems and they extend in one part diagonally over the width of the sheet.

In order to avoid smearing on the sheet transfer drums due to contact of the fresh ink with the jacket surface of the sheet transfer drum, there are provided, according to German Patent DE 35 35 621 C2, small spurs on the jacket surface of that sheet transfer drum which are mounted on guide rods. The spurs support the sheet in unprinted areas and protrude radially from the jacket surface. When not in use, the spurs are brought into a position which is radially pulled-back relative to the jacket surface. Instead of single spurs it is also known from that reference to provide stiff, interconnectable jacket segments. Those jacket segments can be moved in a radially pulled-back position and their format can be adapted.

In order to avoid smearing of the fresh ink in the area of a sheet transfer drum between printing units of a multi-color sheet-fed rotary printing machine for recto-verso printing, hollow sheet guide bars are known from German Patent DD 57 345 (East Germany), from which sheet-supporting air flows out through bores. The sheet is thus prevented from touching the guide bars disposed below the sheet transfer drum.

SUMMARY OF THE INVENTION

It is accordingly an object of the invention to provide a sheet transfer drum of a multi-color sheet-fed rotary printing machine, which overcomes the above-mentioned disadvantages of the heretofore-known devices and methods of this general type and which provides an inexpensive solution that can be adapted to changing printing runs with short change-over times for smear-free sheet transfer on the sheet transfer drum of a rotary printing press provided with several printing units arranged in series configuration.

With the foregoing and other objects in view there is provided, in accordance with the invention, a sheet transfer drum of a multi-color sheet-fed rotary printing machine, comprising:

a central drum body rotatably mounted in a printing machine frame about a drum axis, the drum body having flat sides as seen in an axial view;

at least one gripper system for gripping and slaving a sheet; and jacket segments exchangeably mounted on the flat sides of the drum body, the jacket segments being formed with a hollow interior and being inflatable to an inflated position in which the jacket segments define an essentially closed jacket surface of the sheet transfer drum, and deflatable into a substantially collapsed position.

These features enable the production of the jacket segments from a flexible and air-tight material so that the jacket segments for the printing press used in backside printing can be inflated via an air-supply system. When they are not in use in face-printing, they can be folded.

The use or non-use of the inflatable jacket segments does not only depend on the printing use operation in recto-verso printing, but it is generally decided by the condition of the paper. When using thick, stiff papers, more space is needed and therefore the segments are collapsed, because the sheet will otherwise smear on the one hand and be too strongly deformed on the other hand.

Conversely, the segments are deflated when using thin, unstable paper, in order to guide the sheet along a given (circular) orbit.

In accordance with an added feature of the invention, the drum body is formed with cutouts, the jacket segments are mounted in the drum body, and the jacket segments are extendable through the cutouts.

In accordance with another feature of the invention, the jacket segments are made from a flexible and air-tight material.

In accordance with an additional feature of the invention, the jacket segments are bellows-shaped jacket segments, and the jacket segments include inserts which cause the jacket segments to assume a substantially circularly arcuate shape upon inflation. In other words, the inserts effect an unfolding during inflation with an approximately circular outer surface which is the contact surface for the sheet. Preferably, those inserts can also effect automatic folding of the bellows-shaped jacket segments when they are ventilated.

Jacket segments formed according to the invention, can remain in their place when they are not being used, for example when printing on cardboard. If need be, the folded or collapsed jacket segments are secured by special holders, clamping bands, clamping clips or the like.

If needed, for example for thinner printing material which has a tendency to flutter, the jacket segments are inflated after detaching the holder or the like so that the jacket segments take their balloon-like shape.

In accordance with a further feature of the invention, the transfer drum includes means defining an air film expanding over the jacket surface of the jacket segments for carrying the sheet.

In accordance with again an added feature of the invention, the jacket segments have jacket walls formed with openings connecting the interior with an exterior surface of the jacket segments, the openings forming the air-film defining means. In a preferred embodiment, the jacket segments are formed of porous material. It is advantageous for drying purposes, when the pressurized air which forms the air-film or air-cushion is heated air which is guided through the openings in the jacket walls for drying freshly printed sheets. The air-film or air-cushion is a particularly advantageous feature of the inventive concept. The air film carries the sheet on the sheet transfer drum. This prevents the sheet from touching the sheet transfer drum with its fresh ink.

In a further development of the invention, the peripheral wall of the jacket segments has throughholes formed therein so that air flows from the interior of the jacket segments onto the jacket surface. The air is then evenly distributed below the sheet as an air film. In order to attain a drying effect, heated air can be blown into the jacket segments so that the heated air flows through the throughholes and under the sheet from the interior of the jacket segment. The heated air also expands as a supporting air film. An exemplary variation of this concept provides for the jacket wall of each individual jacket segment in the area of the jacket surface to consist of a porous material. Rubber is preferred for the manufacture of the jacket segments, especially for the foldable or collapsible wall areas.

In accordance with again an additional feature of the invention, the jacket segments include a bellows formed of rubber.

In accordance with again another feature of the invention, the jacket segments are plastic bellows with inserts defining a shape thereof in the inflated position.

In the preferred embodiment, the jacket segment is one of a plurality of jacket segments disposed adjacent one another in an axial direction on the drum body.

In accordance with yet an additional feature of the invention, the at least one gripper system is one of a plurality of gripper systems disposed circumferentially behind each other on the drum body, and the jacket segments are disposed between respective ones of the gripper systems in circumferential direction.

In accordance with again a further feature of the invention, the jacket surface defined by the jacket segment is an ink-repellant surface. In a preferred embodiment, therefore, the jacket segment is a bellows-shaped, foldable jacket segment and the jacket surface has a glass-bead surface structure.

In accordance with concomitant features of the invention, the jacket surface of the jacket segment includes an ink-repellant cover. The cover is preferably loosely disposed on the jacket surface of the jacket segment.

In summary, therefore, the jacket segments can be formed as cushions in such a way that several jacket segments are arranged next to each other in crosswise direction of the printing machine (the longitudinal direction is defined by the sheet travel through the printing machine). It is also possible to adapt the stiffening inserts and the blanks of the jacket segments to special working conditions, for example in such a way that the jacket surface of an inflated jacket segment differs from the circular shape of the jacket surface. Adjustments of such characteristics are delegated to the press engineer, who will provide the proper adjustments in order to obtain the desired advantages.

Jacket segments which are constructed according to the invention can be exchangeably attached on the drum body. It is thus easy to quickly adapt to a new format by exchanging the jacket segments. The jacket segments are attached on the flat parts of the jacket body by means of screws or bolts, by lockable snap locks, or in any other suitable way.

Finally, the jacket segments may be attached inside the drum body instead of on the drum body. The expansion can be effected through cut-outs in the drum body. This embodiment leads to substantially improved cylinder rigidity.

Other features which are considered as characteristic for the invention are set forth in the appended claims. Although the invention is illustrated and described herein as embodied in a sheet transfer drum of a multi-color sheet-fed rotary printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
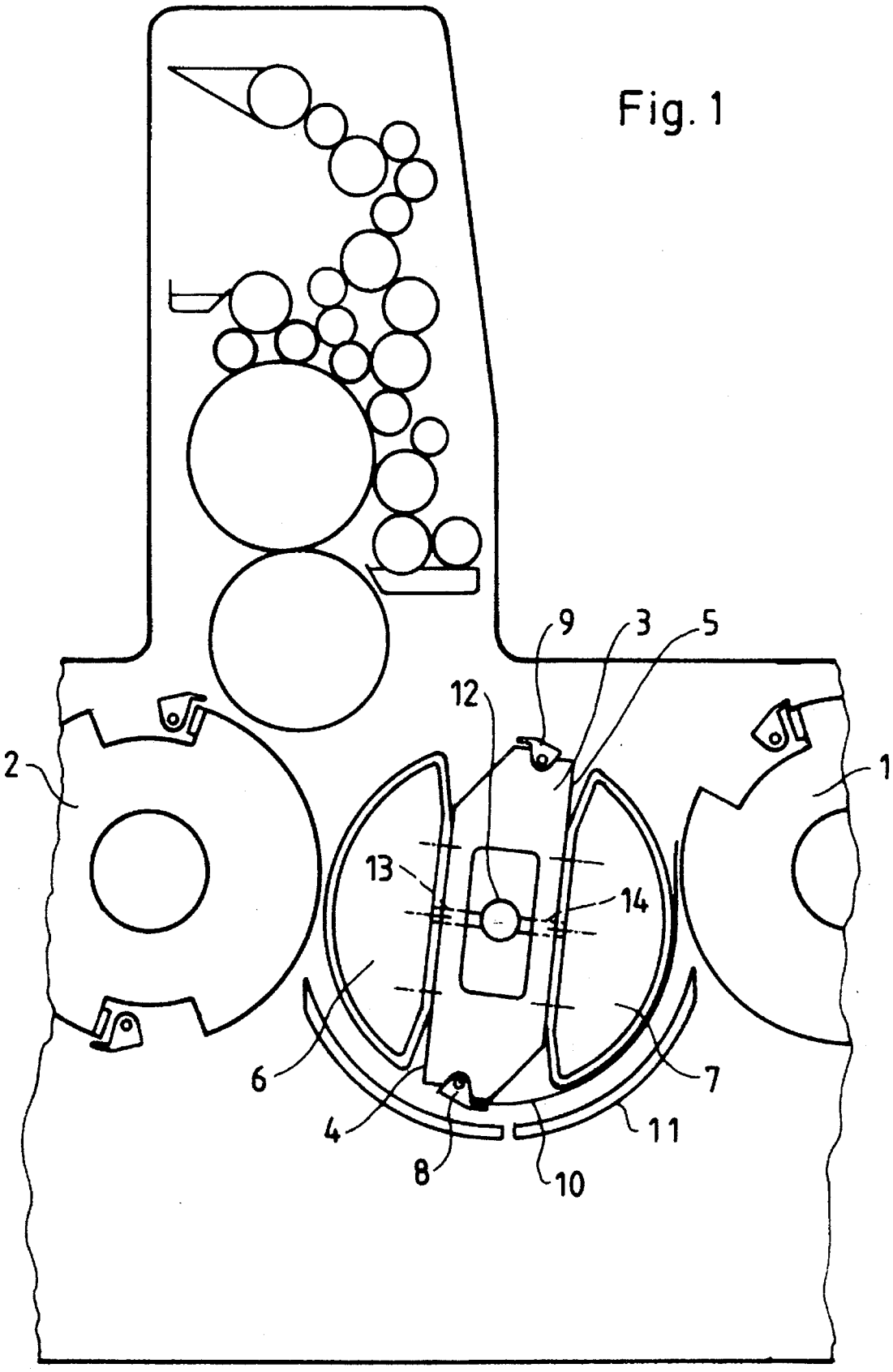
FIG. 1 a fragmentary, cross-sectional view taken through a multiple diameter sheet transfer drum between two printing units of a multi-color sheet-fed rotary printing machine, in operation.

Referring now to the figures of the drawing in detail and first, particularly, to FIG. 1 thereof, there is seen a sheet transfer drum disposed between printing cylinders 1 and 2 of two printing units of a multi-color sheet-fed rotary printing machine. The sheet transfer drum is a multiple diameter drum. The printing cylinders 1 and 2 of the printing units are also multiple diameter cylinders. The sheet transfer drum has a central drum body 3 which is rotatably mounted about a drum shaft in the machine frame. The drum body 3 is approximately rectangular in section. Flat parts 4 and 5 for fastening one of the jacket segments 6 and 7, respectively, are formed on both of the longitudinal, mutually parallel sides. On the short sides of the drum body 3 there are mounted gripper systems 8 and 9, respectively. The grippers successively grip a sheet 10 at its leading edge and transfer them from the printing cylinder 1 to the printing cylinder 2. Conventional concavely bent plate guides 11, guide rods, or the like are disposed below the sheet transfer drum.

The jacket segments 6 and 7 which are attachable to the flat parts 4 and 5 of the drum body 3 are manufactured from a flexible material and the are formed with an inflatable interior. The necessary air supply is effected through a central axle conduit 12 in the drum body 3 and radial channels 13 and 14 communicating therewith. The radial channels 13 and 14 lead into the interior of the jacket segments 6 and 7. The form of the jacket segments 6 and 7 as seen in FIG. 1 is attained by suitably cutting the material blanks used in the manufacture of the jacket segments and by means of reinforcing, stiffening inserts.

Figure 2:
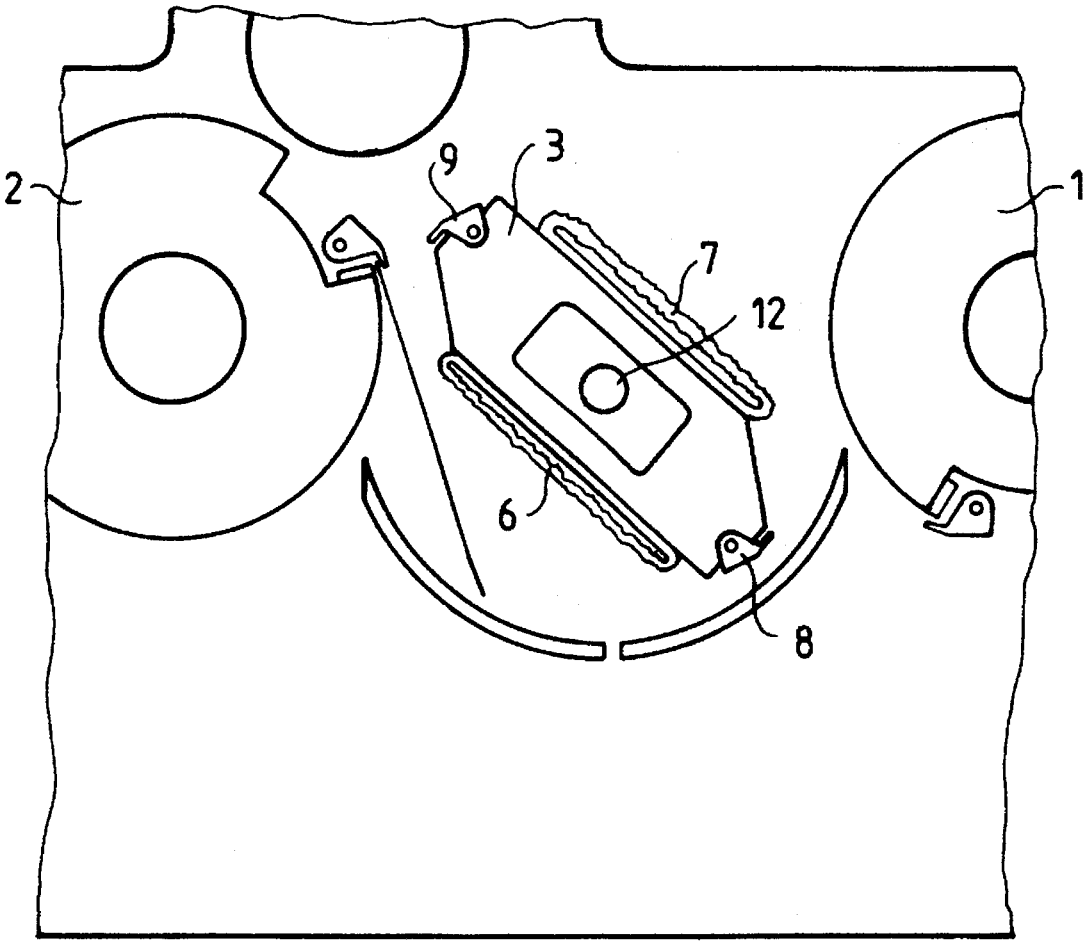
FIG. 2 a diagrammatic, fragmentary, cross-sectional view through the sheet transfer drum with folded jacket segments.

The jacket segments 6 and 7 according to the embodiment in FIG. 2 can fold or collapse with the aid of special stiffening inserts, when the interior of the jacket segments is ventilated. Non-illustrated clamping bands or the like may be used to secure the folded or collapsed position of the jacket segments 6 and 7 shown in FIG. 2.

Figure 3:
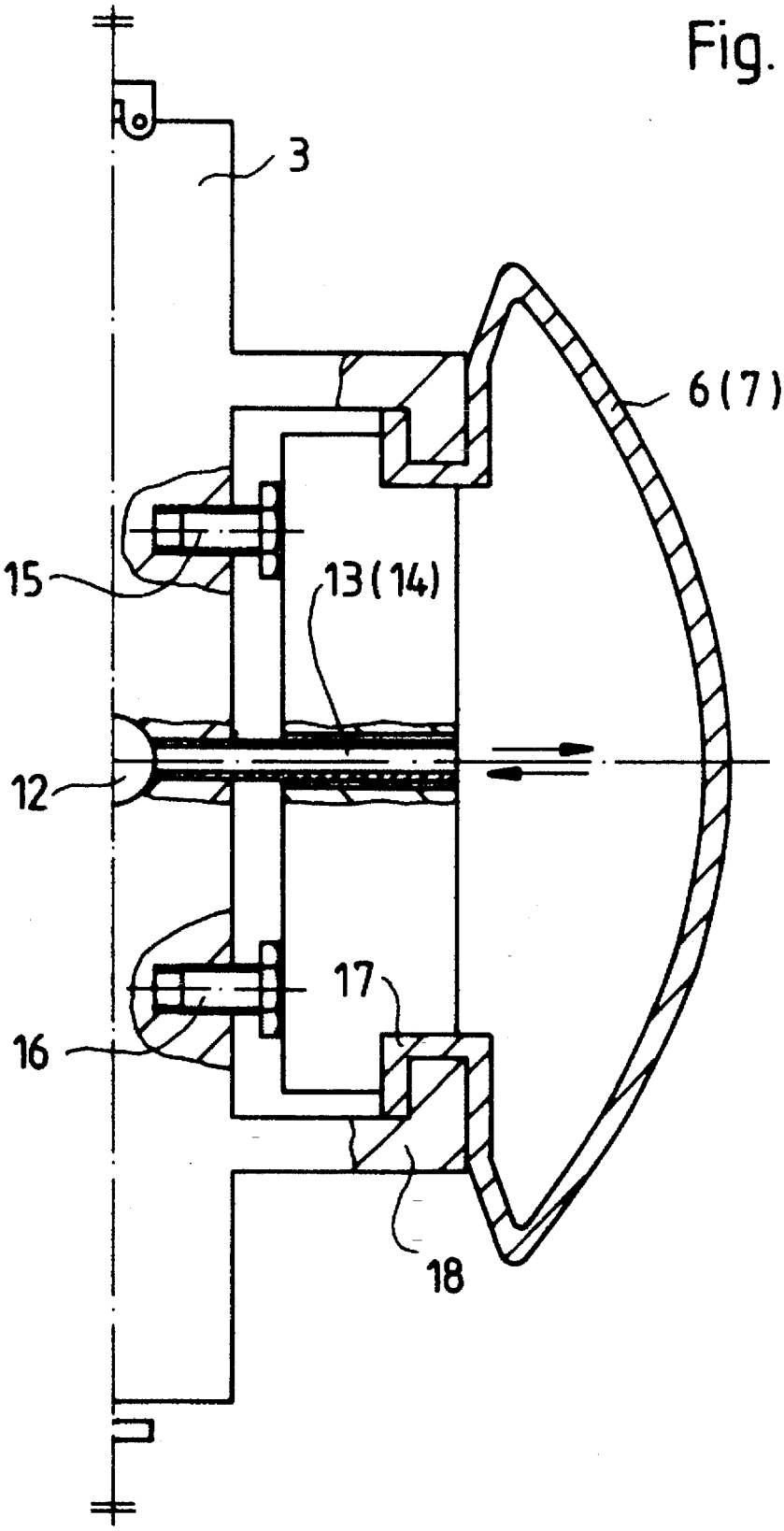
FIG. 3 a cross-sectional view through a jacket segment, however enlarged relative to FIG. 2; and FIGS. *4a–c* are three partial views similar to the cross-section of FIG. 3, of various jacket segment embodiments.

With reference to FIG. 3, screw connectors 15 and 16, or other means such as, for example, lockable snap locks, bayonet closures, or the like are suitably used for detachably securing the jacket segments 6 and 7 on the flat parts 4 and 5 of the drum body 3. There is shown in FIG. 3 an exemplary variation for fastening the jacket segment 6, namely a dovetail-shaped base part 17, which is inserted into a complementary guide 18. The guide structure 18 is formed on a flat side of the drum body 3, and it extends parallel to the drum axis. The jacket segment 6 is thus inserted by shifting it parallel to the drum axis below the L-brackets defined by the guide 18 and it is thereup fastened with the screw connections 15 and 16.

The top surface of the jacket segments 6 and 7 may be formed of an ink-repellant material or they may be provided with a coating for that purpose. Suitable are, for example, glass-bead structures of the jacket segment surface or ink-repellant coatings, such as fabric screen layers, which lie loosely on the top surface of the jacket segments 6 and 7.

Figure 4A:
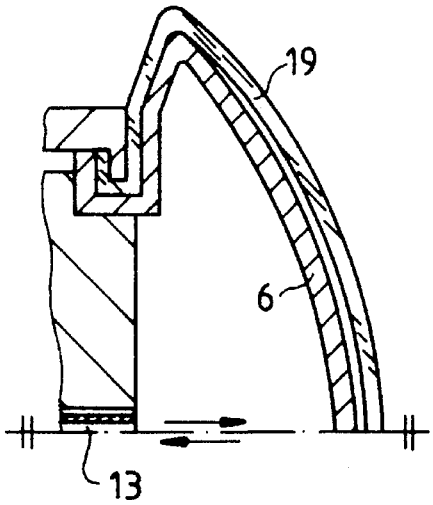

FIG. 4*a* shows a jacket segment 6 with an ink-repellant coating 19, for example a coating made from a perl-beaded screen or a glass-bead cloth.

Figure 4B:
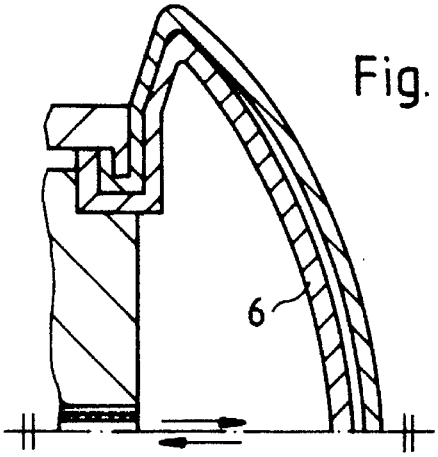

Instead of such a glass-bead coating there is provided in the exemplary embodiment of FIG. 4*b*, a fabric coating, which also has ink-repellant characteristics.

Figure 4C:
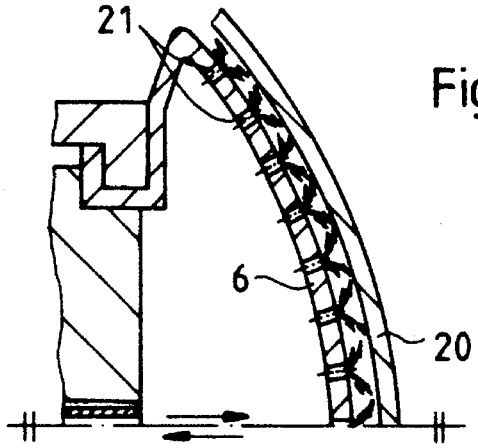

In FIG. 4*c* there is illustrated the above-mentioned formation of an air cushion under the printing material 20. The air (possible heated air) escapes through openings 21 or a symmetrical perforation of the jacket wall of the jacket segments 6, and it flows into the entire area or selectively only into partial areas.

I claim:

1. A sheet transfer drum of a multi-color sheet-fed rotary printing machine, comprising:

a central drum body rotatably mounted in a printing machine frame about a drum axis, said drum body having flat sides as seen in an axial view;

at least one gripper system for gripping and slaving a sheet; and jacket segments exchangeably mounted on said flat sides of said drum body, said jacket segments being formed with a hollow interior and being inflatable to an inflated position in which said jacket segments define an essentially closed jacket surface of the sheet transfer drum, and deflatable into a substantially collapsed position.

2. The sheet transfer drum according to claim 1, wherein said drum body is formed with cutouts, said jacket segments are mounted in said drum body and said jacket segments are extendable through said cutouts.

3. The sheet transfer drum according to claim 1, wherein said jacket segments are made from a flexible and airtight material.

4. The sheet transfer drum according to claim 1, wherein said jacket segments are bellows-shaped jacket segments, and said jacket segments include inserts causing said jacket segments to assume a substantially circularly arcuate shape upon inflation.

5. The sheet transfer drum according to claim 1, including means defining an air film expanding over said jacket surface of said jacket segments for carrying the sheet.

6. The sheet transfer drum according to claim 5, wherein said jacket segments have jacket walls formed with openings connecting said interior with an exterior surface of said jacket segments, said openings forming said air-film defining means.

7. The sheet transfer drum according to claim 6, wherein said air-film defining means guide heated air through said openings in said jacket walls for drying freshly printed sheets.

8. The sheet transfer drum according to claim 5, wherein said jacket segments are formed of porous material.

9. The sheet transfer drum according to claim 1, wherein said jacket-segments include a bellows formed of rubber.

10. The sheet transfer drum according to claim 1, wherein said jacket segments are plastic bellows with inserts defining a shape thereof in the inflated position.

11. The sheet transfer drum according to claim 1, wherein said jacket segment is one of a plurality of jacket segments disposed adjacent one another in an axial direction on said drum body.

12. The sheet transfer drum according to claim 1, wherein said at least one gripper system is one of a plurality of gripper systems disposed circumferentially behind each other on said drum body, and said jacket segments are disposed between respective ones of said gripper systems in circumferential direction.

13. The sheet transfer drum according to claim 1, wherein said jacket surface defined by said jacket segment is an ink-repellant surface.

14. The sheet transfer drum according to claim 13, wherein said jacket segment is a bellows-shaped, foldable jacket segment and said jacket surface has a glass-bead surface structure.

15. The sheet transfer drum according to claim 13, wherein said jacket surface of the jacket segment includes an ink-repellant cover.

16. The sheet transfer drum according to claim 15, wherein said cover is loosely disposed on said jacket surface of said jacket segment.

* * * * *